US007764803B2

(12) United States Patent
Kang

(10) Patent No.: US 7,764,803 B2
(45) Date of Patent: Jul. 27, 2010

(54) SPEAKER APPARATUS USING DISPLAY WINDOW

(75) Inventor: Chung-Gu Kang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 1363 days.

(21) Appl. No.: 11/180,615

(22) Filed: Jul. 14, 2005

(65) Prior Publication Data

US 2006/0012559 A1 Jan. 19, 2006

(30) Foreign Application Priority Data

Jul. 16, 2004 (KR) ..... 10-2004-0055737

(51) Int. Cl.
*H04R 25/00* (2006.01)

(52) U.S. Cl. ..... 381/152; 381/333; 381/388

(58) Field of Classification Search ..... 381/152, 381/306, 333, 337, 388, 396, 398, 423, 431; 361/681, 682, 683, 686; 379/428.01, 433.02
See application file for complete search history.

(56) References Cited

U.S. PATENT DOCUMENTS

| | | | | |
|---|---|---|---|---|
| 3,247,925 | A * | 4/1966 | Warnaka | 381/398 |
| 7,174,025 | B2 * | 2/2007 | Azima et al. | 381/152 |
| 7,391,879 | B2 * | 6/2008 | Beer et al. | 381/423 |
| 2001/0026625 | A1 * | 10/2001 | Azima et al. | 381/152 |
| 2002/0065113 | A1 | 5/2002 | Mori | |
| 2002/0075135 | A1 | 6/2002 | Bown | |
| 2002/0118847 | A1 | 8/2002 | Kam | |

FOREIGN PATENT DOCUMENTS

| | | | |
|---|---|---|---|
| EP | 0323110 | A2 | 7/1989 |
| FR | 2 336 721 | A1 | 7/1977 |
| GB | 2 062 408 | A | 5/1981 |
| JP | 58-059699 | A | 4/1983 |
| JP | 58-194228 | A | 11/1983 |
| JP | 60-101890 | U | 7/1985 |
| JP | 63-26198 | A | 2/1988 |
| JP | 3-780-22 | A | 4/1991 |
| JP | 2000-358290 | A | 12/2000 |
| JP | 2001-189978 | A | 7/2001 |
| JP | 2002-252895 | A | 9/2002 |
| JP | 2003-18686 | A | 1/2003 |
| JP | 2003-102087 | A | 4/2003 |
| JP | 2006-500803 | A | 1/2006 |
| WO | WO-97/09842 | A2 | 3/1997 |
| WO | WO-99/45423 | A1 | 9/1999 |
| WO | WO-00/02417 | A1 | 1/2000 |
| WO | WO-03/049493 | A1 | 6/2003 |
| WO | WO-2004/019652 | A2 | 3/2004 |
| WO | WO-2004/100600 | A2 | 11/2004 |

* cited by examiner

*Primary Examiner*—Huyen D Le
(74) *Attorney, Agent, or Firm*—Birch, Stewart, Kolasch & Birch, LLP

(57) ABSTRACT

A speaker apparatus for a mobile communications terminal includes a display window acts as a speaker by using the display window as a vibration plate. As a result, sound in lower frequency range can be reproduced. In addition, through use of filters, frequency characteristics can be further enhanced.

20 Claims, 5 Drawing Sheets

SPEAKER APPARATUS USING DISPLAY WINDOW

PRIORITY

This nonprovisional application claims priority under 35 U.S.C. §119(a) on Patent Application No. 55737/2004 filed in Korea on Jul. 16, 2004, which is herein incorporated by reference.

BACKGROUND OF THE INVENTION

1. Field of the Invention

The present invention relates to a speaker apparatus, and particularly, to a speaker apparatus for a mobile device using a display window.

2. Description of the Related Art

Development of communication technologies and increase in user requirements have recently enabled mobile communications terminals (hereinafter, referred to as a 'terminal') to provide multimedia functions such as music, videos, games, and the like in addition to the typical calling function. In order to provide these and other multimedia functions, as shown in FIG. 1, the terminal can come equipped with a highly functional loud speaker 10 independently of a typical receiver speaker.

The loud speaker 10 includes one or two circular speakers with a diameter of approximately 10~15 mm, and is generally mounted in a case or in a hinge unit in case of a folder-type terminal.

However, the size of the loud speaker 10 is limited, typically to the diameter of 10~15 mm, as shown in FIG. 2. As a result, the frequency response of the loud speaker is also limited, especially in a frequency region under 700 Hz (low sound). As the vibration plate of the speaker becomes smaller, the reproducing frequency response characteristic is moved toward higher frequencies. Lower frequency characteristics may be enhanced by installing speakers with larger diameters, but this option is limited due to the devices themselves getting smaller and smaller.

SUMMARY OF THE INVENTION

Therefore, an object of the present invention is to provide a speaker apparatus capable of effectively reproducing sound in all frequency ranges including low frequency region by using a display window as a vibration plate.

To achieve these and other advantages and in accordance with the purpose of the present invention, as embodied and broadly described herein, a speaker apparatus may include a display window for protecting a display module; a support member for elastically supporting the display window; and a vibrator for vibrating the display window to generate a sound when an electrical audio signal is inputted.

The support member may be a coil spring which supports the corners and/or edges of the display window.

The vibrator may be positioned in the corners and/or the edges of the display window. The vibrator may include a permanent magnet or a magnetic material attached to the display window, and an electromagnet arranged to face the permanent magnet or magnetic material. The magnetic material can be a metal or any other material to which physical force may be exerted under magnetism The magnetism of the electromagnet may be varied according to a variance of an electrical audio signal, for example a variance in the strength of the electrical audio signal.

The display window, the support member, and the vibrator may be positioned in a cabinet which has a concave a chamber-like shape.

A stopping jaw may be formed at an outer circumference of the display window and a first rib corresponding to the stopping jaw may protrude from the cabinet. The stopping jaw and the first rib may have a gap therebetween so as not to influence each other while vibrating.

A second rib for preventing the display window from being separated from the terminal may protrude from the stopping jaw, and a damper may be installed between the first and second ribs.

The speaker apparatus using the display window may further include a filter for filtering the electrical audio signals received from an audio interface so that the electrical audio signals within a desired frequency range or ranges are provided to the vibrator.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

In an embodiment of the present invention, a speaker apparatus is provided for a mobile communications terminal capable of effectively reproducing sound in a low frequency region by using a display window as a vibration plate. While a mobile communications terminal is discussed for simplicity, the embodiments of the invention are capable of being applied to any type of mobile devices, for example PDAs and MP3 players, where it is preferred to keep the overall dimensions of the mobile devices themselves to a minimum.

For this purpose, an aspect of the present invention embodies a speaker apparatus for using a display window as a vibration plate in which a permanent magnet or a magnetic material is mounted, for example in one or more corners or edges of the display window, and an electromagnet is positioned to face the permanent magnet or magnetic material.

The size of the display window in each mobile device may be different depending on the type of the device. A folder-type communication terminal may use a display window with a cross-sectional length of about 50 mm, which corresponds to being approximately three to five times as long as the diameter of of the speaker typically used in the related art. In other words, the cross-sectional area of the display window is roughly nine to fifteen times as large as the speaker of the related art and therefore should have better low frequency characteristics.

Figure 1:
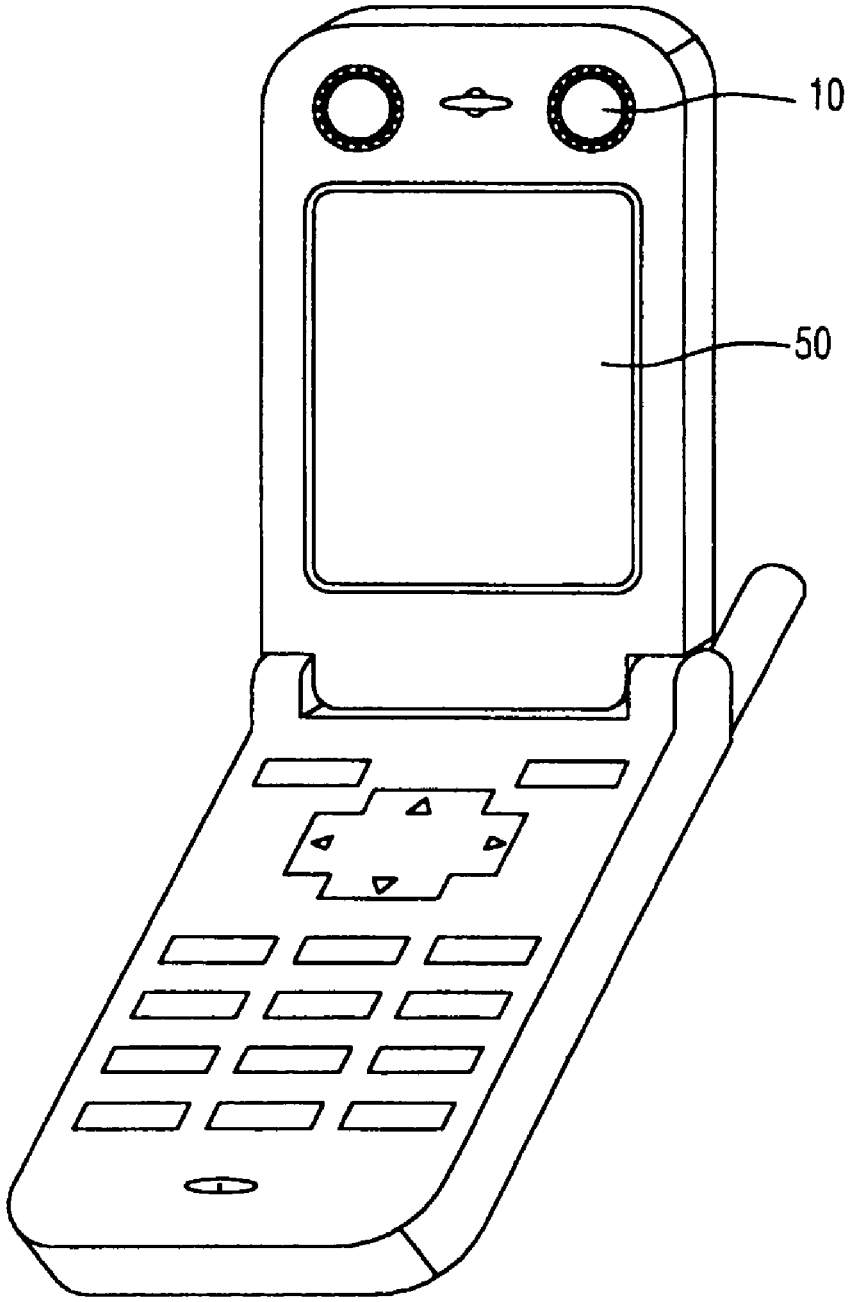
FIG.1 Related Art
FIG. 1 is a perspective view showing a mobile communications terminal provided with a related art loud speaker.
Figure 2:
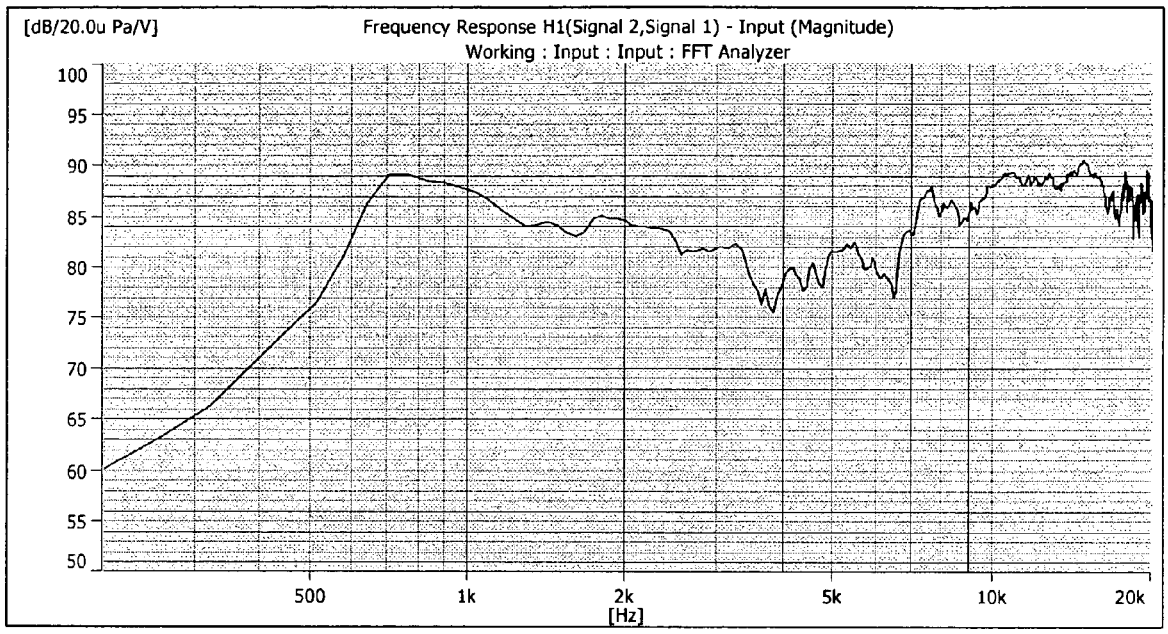
FIG.2 Related Art
FIG. 2 shows frequency characteristics of outputs of the related art loud speaker.
Figure 3:
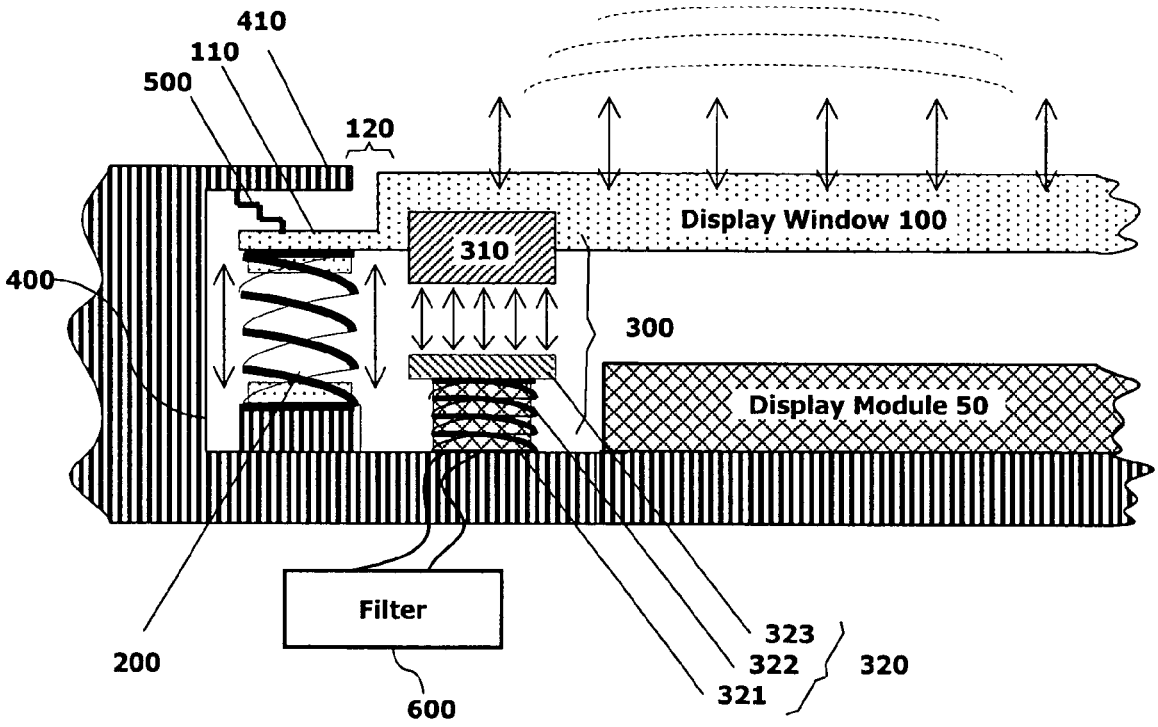
FIG. 3 is a partial sectional view showing a structure of a speaker apparatus using a display window according to an embodiment of the present invention.
Figure 4:
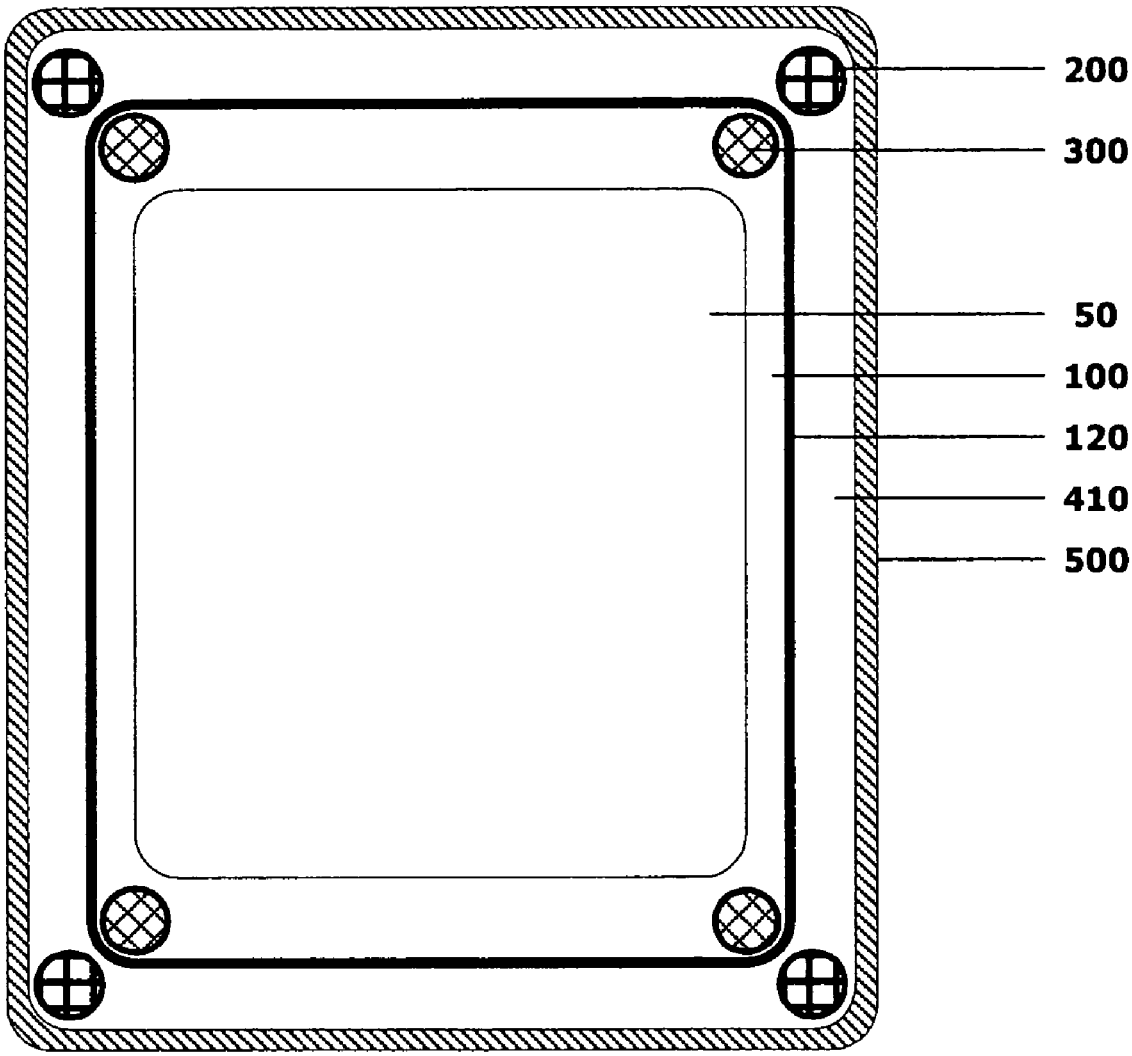
FIG. 4 is a plane view showing positions of support member and vibrator of the speaker apparatus using the display window according to an embodiment of the present invention.

FIG. 3 is a partial sectional view showing a structure of a speaker apparatus using a display window according to an embodiment of the present invention, and FIG. 4 is a plane view showing installation positions of each support member and vibrator in the speaker apparatus using the display window according to an embodiment of the present invention.

Referring to FIG. 3, the speaker apparatus using the display window according to an embodiment of the present invention includes a display window 100 (i.e., LCD (Liquid Crystal Display) window) for protecting a display module 50; a support member 200 providing elastic support to the display window 100 to provide a predetermine range of gap distance between the display window 100 and the display module 50; and a vibrator 300 for vibrating the display window 100 when an electrical audio signal is received. Multiple support members 200 and the vibrators 300, as shown in FIG. 4, may be mounted in each of four corners of the display window 100. While not shown, the support members 200 and the vibrators 300 may also be mounted on the edges of the display window 100 as well. In general, the support members and the vibrators 300 may be placed in locations to minimize hinderance to view the display module and to maximize the vibration characteristics of the display window 100.

The display module 50 is used for visually displaying information. For instance, a LCD (Liquid Crystal Display) module may be used as the display module 50. The display module 50 is generally structurally weak to physical forces, such an impact from an external source. The display module 50 may be placed in the terminal casing to a predetermined depth. To protect the display module 50 from damage, the transparent display window 100 may be installed above the display module 50. Also a concaved portion or chamber-like portion of the terminal casing may serve as a cabinet 400. The shape of the cabinet 400 serves to reflect sound generated by the vibration to be emitted to the exterior in a single direction.

A shape of the display window 100 may be arbitrary, but is preferred to follow the shape of the display module 50. The display window 100 is preferably a bit larger than the display module 50 so as to provide maximum protection to the display module 50. A rib 110, which is a part of an outer circumference of the display window 100, may be positioned to be overlap with a rib 410 protruding from a side surface of the cabinet 400. The ribs 110 and 410 may act to prevent the display window 100 from being separated from the cabinet 400. A stopping jaw 120 may be provided at a portion where the display window 100 and the rib 410 overlap. The stopping jaw 120 and the rib 410 may have a predetermined gap distance therebetween so that the rib 410 does not act as an obstacle to disturb the vibration of the display window 100.

A damper 500 may be installed between the ribs 110 and 410 to prevent impurities from being introduced into the cabinet 400 and to allow the display window 100 to vibrate without being warped. The damper 500 may be formed from compression sponge or resin used in a typical cone speaker.

Any or all of the corners and/or edges of the display window 100 may be connected with the cabinet 400 by the support member 200. The display window 100 may be elastically supported by the support member 200 so that the display window 100 can be vibrated by the vibrator 300. The support member 200 may be formed from a coil spring or any other compressible material to elastically support the display window 100. The vibrator 300 may be installed between the display window 100 and the display module 50. When a force by the vibrator 300 is applied to the display window 100, the support member 200 vibrates and absorbs the load to restore the display window 100 to its original position.

The vibrator 300 is equipped in each of the four edges of the display window 100, respectively. Each vibrator 300 includes a piece of magnet 310 installed on the display window 100 and a magnetism generator 320 installed to face the piece of magnet 310. Preferably, the piece of magnet 310 is embodied with a permanent magnet. The magnetism generator 320 is embodied with a magnet capable of generating great magnetism, for instance, an electromagnet having an iron core in the center of a solenoid 321, the iron core having a great magnetic permeability. Here, a particular shape of plate is provided at the end of the magnetism generator 320, which prevents the solenoid 321 from being separated.

When a time-variable electrical audio signal is provided to the solenoid 321, strength and/or direction in the magnetic field occurs causing the magnet or magnetic material 310 to move. Accordingly, the display window 100 vibrates to generate sound. If it is desired to limit the response of the display window 100 to only a certain range or ranges of frequencies, a filter 600 may be connected to the magnetism generator 320. For example, the filter 600 may be a low pass filter (LPF) to limit the response range of the display window 100 to those frequencies that cannot be adequately be reproduced by the speakers already provided in the device. Preferably, the filter 600 is added to an existing audio interface integrated circuit.

When the filter 600 is connected to the magnetism generator 320, an audio interface (not shown) managing the input/output of a microphone and speaker provided to the mobile device may output the electrical audio signal to the filter 600. The filter 600 may filter the electrical audio signal to provide the solenoid 321 signals corresponding to the allowed sound frequency range.

It should be noted that the filter 600 may also be a band pass and/or high pass filters. This provides the user an ability to enhance the frequency response suited to different types of music or environment. For example, it may be desirable to have better higher frequency characteristics for classical music. Indeed, the frequency response characteristics for the filter or filters 600 attached to the magnetism generator 320 may be adjustable so that the user is able to adjust the response characteristics of the display window 100 as well as any other speakers that may be provided on the mobile device.

An operation of a speaker apparatus using the display window according to an embodiment of the present invention will now be explained.

When sound is to be generated, the audio interface for managing the input/output of the microphone/speaker may output the electrical audio signal to the magnetism generator 320 directly or via the filter 600. As a result, a magnetic polarity and/or the strength generated by the magnetism generator 320 may be changed in response to the electrical audio signal. This change causes the magnet or magnetic material 310 mounted in the display window 100 move. As the magnet or magnetic material 310 moves, the display window vibrates to generate sound.

The magnetism of the magnetism generator 320 may be determined according to the electrical audio signal applied to the solenoid 321. The change in the magnetism generated by the magnetism generator 320 effects the amplitude of the vibration of the display window 100, namely, the strength of the audio generated by the vibration of the display window 100. As the display window 100 vibrates, the support member 200, for example a coil spring provides support to the display window 100 so that the display window can vibrate in a stable manner.

Therefore, a strong low frequency sound or any desired frequency range of sound can be generated by the vibration of the display window 100. When the filter 600 is mounted in the audio interface integrated circuit, the sound of a particular frequency range can be outputted.

Figure 5:
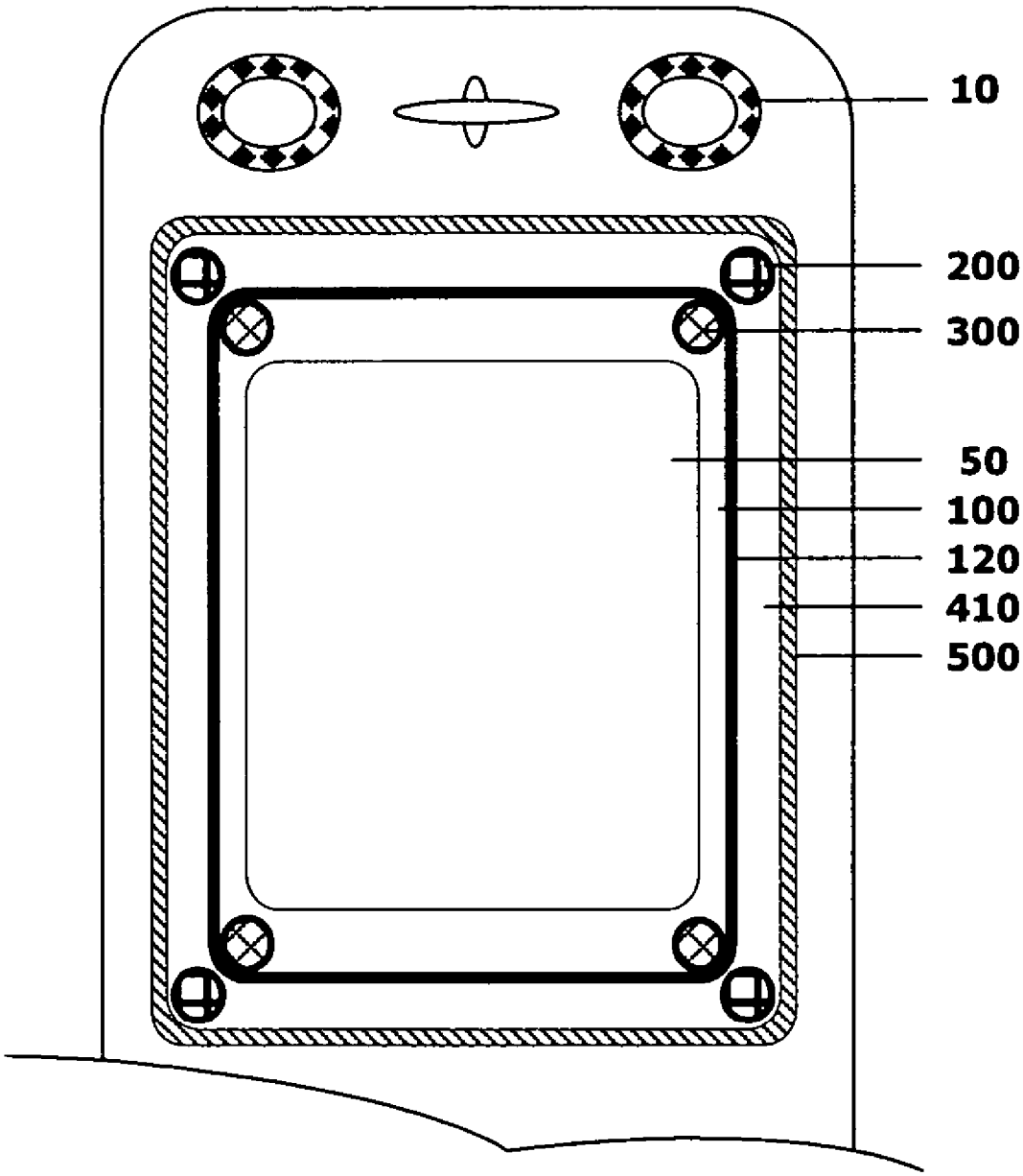
FIG. 5 shows an example in which the speaker apparatus using the display window according to the embodiment of the present invention is coexistent with a loud speaker.

The operation of the speaker apparatus using the display window installed in the mobile device has been explained above. However, the invention not limited only to utilizing the display window. Conventional loud speakers, such as the related art loud speaker 10, as shown in FIG. 5, can be installed along with utilizing the display window. In this instance, the loud speaker 10 may be utilized as a tweeter for generally outputting sound in a high frequency range, and the display window may be utilized as a woofer for generally outputting sound in a low frequency bandwidth. Combined, the lout speakers 10 and the display 100 may reproduce sound more efficiently.

Also, one or more filters, such as the filter 600, may be utilized to enhance the sound quality generated from the loud speakers 10 as well as the display window 100. Further, the response characteristics of the filter 600 may be user adjustable.

As mentioned above, the speaker apparatus using the larger-sized display window than the conventional speaker as the vibration plate can more effectively reproduce sound in the low frequency region which has been difficult to be reproduced using the conventional speaker. Utilizing filters—low pass, band pass, high pass—can also enhance the sound quality.

Furthermore, since the display window is used as a vibration plate, extra space for installing the speaker apparatus is not required. As a result, the overall dimensions of the mobile device can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A speaker apparatus for a mobile device, comprising:

a transparent display window;

a LCD (Liquid Crystal Display) module arranged below the transparent display window such that images generated by the LCD are visible through the transparent display window;

a vibrator configured to vibrate the transparent display window to generate sound when an electrical audio signal is received; and a support unit configured to elastically support the transparent display window;

wherein the support unit is arranged to support one or more corners of the transparent display window or one or more edges of the transparent display window or any combination thereof, wherein the vibrator is positioned at a vicinity of one or more corners of the transparent display window or at a vicinity of one or more edges of the transparent display window or any combination thereof, and wherein the transparent display window and the vibrator are positioned in a cabinet which has a predetermined shape, the speaker apparatus further comprising:

a stopping jaw positioned at an outer circumference of the transparent display window;

a first rib protruding from the cabinet to face the stopping jaw a second rib protruding from the stopping jaw configured to stop the transparent display window from being separated from the mobile communications terminal; and a damper installed between the first and second ribs.

2. The apparatus of claim 1, wherein the vibrator comprises:

a magnet or a magnetic material attached the transparent display window; and a magnetism generator arranged to face the magnet or magnetic material, configured to generate a magnetism according to the electrical audio signal.

3. The apparatus of claim 2, wherein the magnetism generator is an electromagnet.

4. The apparatus of claim 1, wherein the vibrator is installed between the transparent display window and the LCD.

5. The apparatus of claim 1, wherein the stopping jaw and the first rib have a gap therebetween.

6. The apparatus of claim 1, wherein the damper is formed from at least one of a compression sponge or a resin.

7. The apparatus of claim 1, further comprising:

a filter configured to receive the electrical audio signals from an audio interface and output to the vibrator electrical audio signals within a particular frequency range.

8. The apparatus of claim 7, wherein the filter is one of a low pass filter, a band pass filter, and a high pass filter.

9. The apparatus of claim 7, wherein a frequency response characteristics of the filter is adjustable.

10. The apparatus of claim 1, further comprising one or more loud speakers.

11. A speaker apparatus for a mobile device, comprising:

a transparent display window;

a LCD (Liquid Crystal Display) module arranged below the transparent display window such that images generated by the LCD are visible through the transparent display window;

a first magnet or magnetic material mounted on the transparent display window;

a second magnet installed to face the first magnet or magnetic material, the second magnet configured to change a magnetism according to an electrical audio signal outputted from an audio interface to vibrate the transparent display window through an interaction with the first magnet or magnetic material; and a support unit configured to elastically support the transparent display window, and wherein the transparent display window and the second magnet are positioned in a cabinet which has a predetermined shape, the speaker apparatus further comprising:

a stopping jaw positioned at an outer circumference of the transparent display window;

a first rib protruding from the cabinet to face the stopping jaw a second rib protruding from the stopping jaw configured to stop the transparent display window from being separated from the mobile communications terminal; and a damper installed between the first and second ribs.

12. The apparatus of claim 11, wherein the support unit is a coil spring configured to support one or more corners of the transparent display window or one or more edges of the transparent display window or any combination thereof.

13. The apparatus of claim 11, wherein the first magnet or magnetic material is mounted on one or more corners of the transparent display window or one or more edges of the transparent display window or any combination thereof.

14. The apparatus of claim 11, wherein the first magnet or magnetic material is a permanent magnet and the second magnet is an electromagnet.

15. The apparatus of claim 11, further comprising:

a filter configured to output to the second magnet electrical audio signals of a particular frequency range by receiving and filtering electrical audio signals from an audio interface.

16. The apparatus of claim 15, wherein the filter is one of a low pass filter, a band pass filter, and a high pass filter.

17. The apparatus of claim 15, wherein a frequency response characteristics of the filter is adjustable.

18. The apparatus of claim 11, further comprising one or more loud speakers.

19. A speaker apparatus for a mobile device, comprising:

a display module;

a transparent display window configured to protect the display module;

a biasing member configured to bias the display window; and a vibrator configured to vibrate the display window to generate a vibration sound when an electric audio signal is inputted, wherein the vibrator includes:

a permanent magnet mounted on the transparent display window, and an electromagnet positioned directly opposite to the permanent magnet, the electromagnet configured to change the magnetism according to the strength of the electric signal so as to move the permanent magnet along a line connecting the electromagnet to the permanent magnet, and wherein the transparent display window and the vibrator are positioned in a cabinet which has a predetermined shape, the speaker apparatus further comprising:

a stopping jaw positioned at an outer circumference of the transparent display window;

a first rib protruding from the cabinet to face the stopping jaw a second rib protruding from the stopping jaw configured to stop the transparent display window from being separated from the mobile communications terminal; and a damper installed between the first and second ribs.

20. A speaker apparatus for a mobile device, comprising:

a transparent display window;

a first magnet mounted on the display window; and a second magnet positioned directly opposite to the first magnet, the second magnet configured to change a magnetism according to an electric audio signal outputted from an audio interface to vibrate the transparent display window, thereby generating a vibration sound, wherein the first magnet is a permanent magnet and the second magnet is an electromagnet, and wherein the magnetism of the second magnet that changes according to the electric audio signal causes the first magnet to move along a line connecting the first magnet to the second magnet, and wherein the transparent display window and the vibrator are positioned in a cabinet which has a predetermined shape, the speaker apparatus further comprising:

a stopping jaw positioned at an outer circumference of the transparent display window;

a first rib protruding from the cabinet to face the stopping jaw a second rib protruding from the stopping jaw configured to stop the transparent display window from being separated from the mobile communications terminal; and a damper installed between the first and second ribs.

* * * * *